US005223903A

United States Patent [19]

Russel et al.

[11] Patent Number: 5,223,903

[45] Date of Patent: Jun. 29, 1993

[54] SHEET TRANSPORT DEVICE FOR IMAGE-FORMING APPARATUS

[75] Inventors: Steven M. Russel, Pittsford; Dennis J. Grabb, Sodus; Mark C. Zaretsky, Rochester; John J. Meyers, Penfield, all of N.Y.

[73] Assignee: Eastman Kodak Company, Rochester, N.Y.

[21] Appl. No.: 871,316

[22] Filed: Apr. 20, 1992

[51] Int. Cl.[5] ..... G03G 21/00

[52] U.S. Cl. ..... 355/308; 271/195; 355/271; 355/282; 355/309

[58] Field of Search ..... 355/271, 273, 277, 282, 355/285, 295, 308, 309, 312; 271/195

[56] References Cited

U.S. PATENT DOCUMENTS 4,493,548 1/1985 Ateya ..... 355/312
4,561,758 12/1985 Lang ..... 355/233
4,572,071 2/1986 Cappel et al. ..... 271/195 X
4,967,231 10/1990 Hosoya et al. ..... 355/271 X
5,063,415 11/1991 Ariyama ..... 355/312

FOREIGN PATENT DOCUMENTS 0095562 6/1984 Japan ..... 355/312

*Primary Examiner*—A. T. Grimley
*Assistant Examiner*—Matthew S. Smith
*Attorney, Agent, or Firm*—Leonard W. Treash

[57] ABSTRACT

A receiving sheet having a loose toner image on a surface of the sheet is transported from an image member to a fuser by continuing movement of the image member. To prevent disruption of the loose toner image and to accommodate any difference in speeds of the image member and the fuser, air is directed on the image side of the receiving sheet to force the receiving sheet against a curved guide positioned behind the receiving sheet.

17 Claims, 7 Drawing Sheets

SHEET TRANSPORT DEVICE FOR IMAGE-FORMING APPARATUS

This invention relates to a sheet transport device for an image-forming apparatus. It is particularly useful in transporting a receiving sheet carrying a toner image from an image member to a fixing device.

BACKGROUND ART

U.S. Pat. No. 4,493,548 to Ateya, issued Jan. 15, 1985 shows an air transport device comparable to those in use today on high speed, single-pass duplex, duplicating machines. The machines for which they are designed create toner images on both sides of a receiving sheet before either image is fixed. To transport the receiving sheet from an image member to a fixing device without disturbing either loose toner image, the sheet is supported on a layer of forced air as it is pushed to the fixing device by the image member. This Unfused Copy Air Transport is called a UCAT. Its development permitted the simultaneous fixing of toner images on opposite sides of a sheet. Toner image-bearing sheets are suspended above a stationary surface by means of air flowing out through small ports in the surface. Airflow through the ports is supplied by a blower which maintains a suitable positive pressure inside a plenum chamber below the surface. The ports are angled and the surface featured in such a way as to push and pull on the sheet at the same time, effectively regulating the height of the sheet above the air plenum.

For double-pass duplex or for simplex applications, a vacuum transport is often employed. Sheets emerging from a transfer station are held against a moving belt as a result of negative pressure in a vacuum chamber behind the belt.

Positive air systems work well in the transport of paper but face a problem associated with interaction between upstream and downstream drive systems. Thus, when a sheet enters a faster moving fixing device nip, the air transport cannot resist and the sheet slips along it, tugging at the slower moving image member portion of the process. If a vacuum transport is used, the distance between the transfer and fixing stations can be made longer than the longest sheet. Although this may not permit a compact apparatus, it allows the fixing device to be run at any speed equal to or faster than the transfer station. If the entire drive for the sheet to the fixing device is supplied by the image member, the designer is forced to set the spacing between the image member and the fixing device at the shortest paper length and live with whatever harmful interactions exist for longer paper lengths.

U.S. Pat. No. 4,561,756 to Lang, issued Dec. 31, 1985, suggests speed mismatch compensation between the image member and a fixing device by allowing the sheet under the force of gravity to buckle against a set of baffles. The fusing device is deliberately run slightly slower than the image member to force the buckle in a direction controlled by the baffles. One of the baffles is grounded to attract the receiving sheet in a generally downward direction to help form the buckle.

SUMMARY OF THE INVENTION

It is an object of the invention to provide an image-forming apparatus in which a receiving sheet is transported from an image member to a fixing device without disrupting a loose toner image on the receiving sheet, despite a possible difference in sheet transport speeds of the image member and the fixing device.

This and other objects are accomplished by providing a means for controlling movement of the receiving sheet between the image member and the fixing device which includes a guide positioned on the nonimage-bearing side of the receiving sheet to guide the receiving sheet along a curved path. Means are provided to urge the sheet against the guide.

According to a preferred embodiment, a positive air transport is positioned on the image side of the receiving sheet. It directs air at the image side of the receiving sheet with sufficient force to deflect the sheet into the curved path controlled by the guide. The receiving sheet enters the fixing device, for example a roller-fuser, from the curved path. The fixing device moves the sheet at a speed slightly faster than it is being moved by the image member which gradually straightens the receiving sheet away from the guide despite the air deflection. Preferably, the receiving sheet leaves the image member before or as it becomes perfectly straight and, thus, there is no danger of smearing the image because of a tugging by the fixing device of the receiving sheet.

DESCRIPTION OF THE PREFERRED EMBODIMENTS

Figure 1:
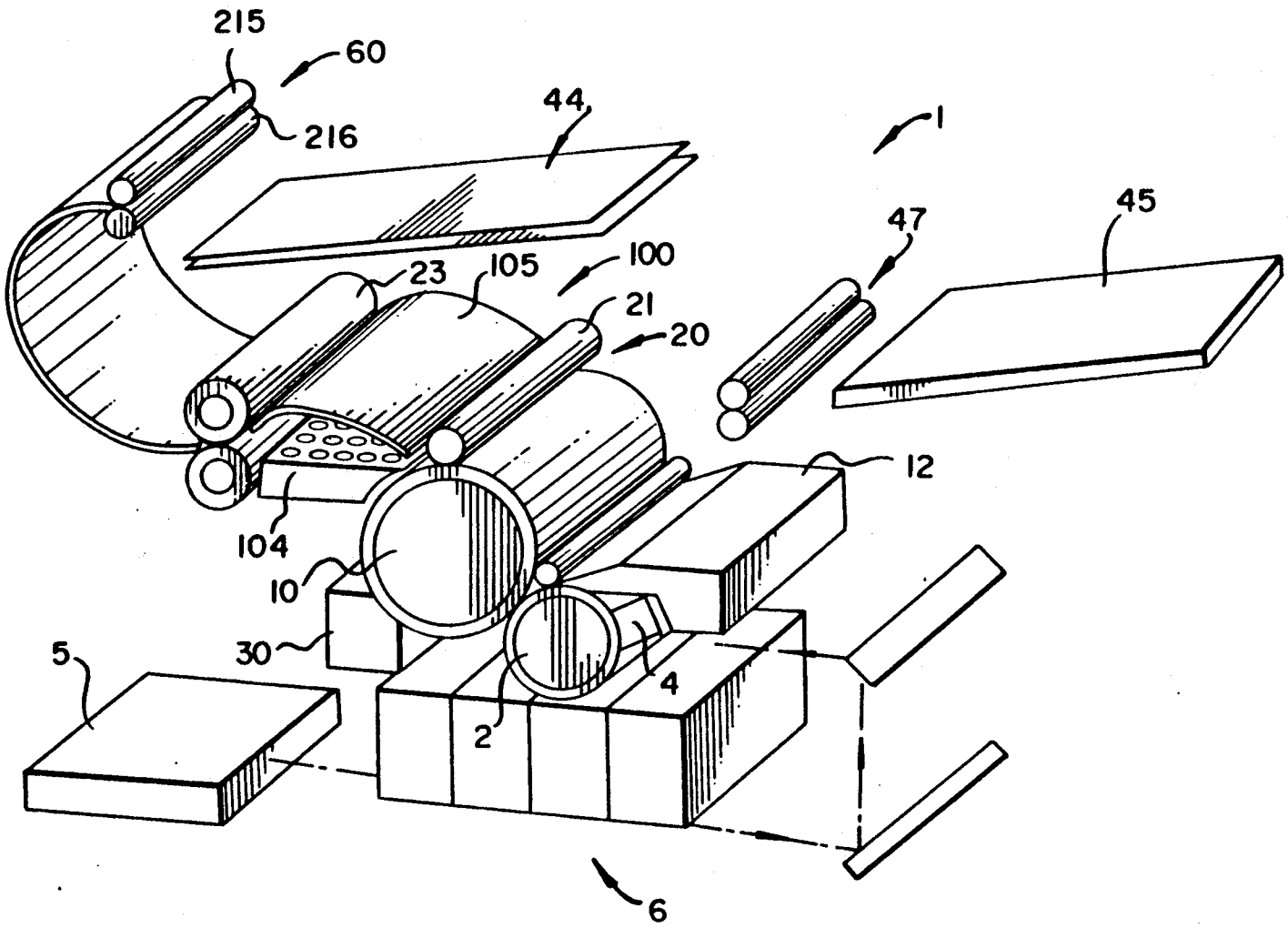
FIG. 1 is a perspective schematic of an image-forming apparatus in which the invention is usable.

According to FIG. 1, an image-forming apparatus 1 includes a primary image member, for example, photoconductive drum 2, which is rotatable past a series of stations to form a series of toner images on its periphery. More specifically, the periphery of drum 2 is uniformly charged by a charging device 4. An exposing device, for example, a laser 5, exposes the charged periphery to create a series of electrostatic images thereon. The electrostatic images are toned by a development device 6. Development device 6 includes four separate toning stations which are indexed into operative relation with drum 2 to apply a different color toner to each of four consecutive images to create a series of different color toner images.

The series of different color toner images are transferred in registration to an image surface on an intermediate image member, for example an intermediate drum 10. The four single-color images, when transferred in registration, form a multicolor image on the image surface of intermediate drum 10. The multicolor image is transferred to a receiving sheet at a transfer station 20. The receiving sheet is fed from a receiving sheet supply 45 through a pair of conventional timing rollers 47 into a nip formed by intermediate drum 10 and an articulatable transfer backing roller 21 at transfer station 20. Transfer backing roller 21 is biased to attract the toner in the multicolor image to the receiving sheet. As the receiving sheet exits the nip between transfer roller 21 and intermediate drum 10, it is driven by drum 10 toward a fixing station or device, for example a roller fuser 23. Transport of the receiving sheet from the intermediate image member 10 to fuser 23 is controlled by an air transport device 100 which will be more thoroughly explained with respect to FIGS. 2-7.

After the receiving sheet exits fuser 23, it is guided to a pair of sheet-feeding rollers 60 and, hence, to an output tray 44 positioned generally above the fuser 23 and the transport device 100. The mechanism for guiding the receiving sheet between the fuser 23 and the sheet-feeding rollers 60 will be described more thoroughly with respect to FIGS. 8-10.

The photoconductive drum 2 is continuously cleaned by a blade cleaner 12 while intermediate drum 10 is intermittently cleaned by a suitable cleaning mechanism 30 which is articulated in and out of cleaning relation with drum 10. Photoconductive drum 2, charging device 4 and photoconductive drum cleaner 12 can all be supplied in a cartridge convenient for replacement of the components included in it.

Figure 2:
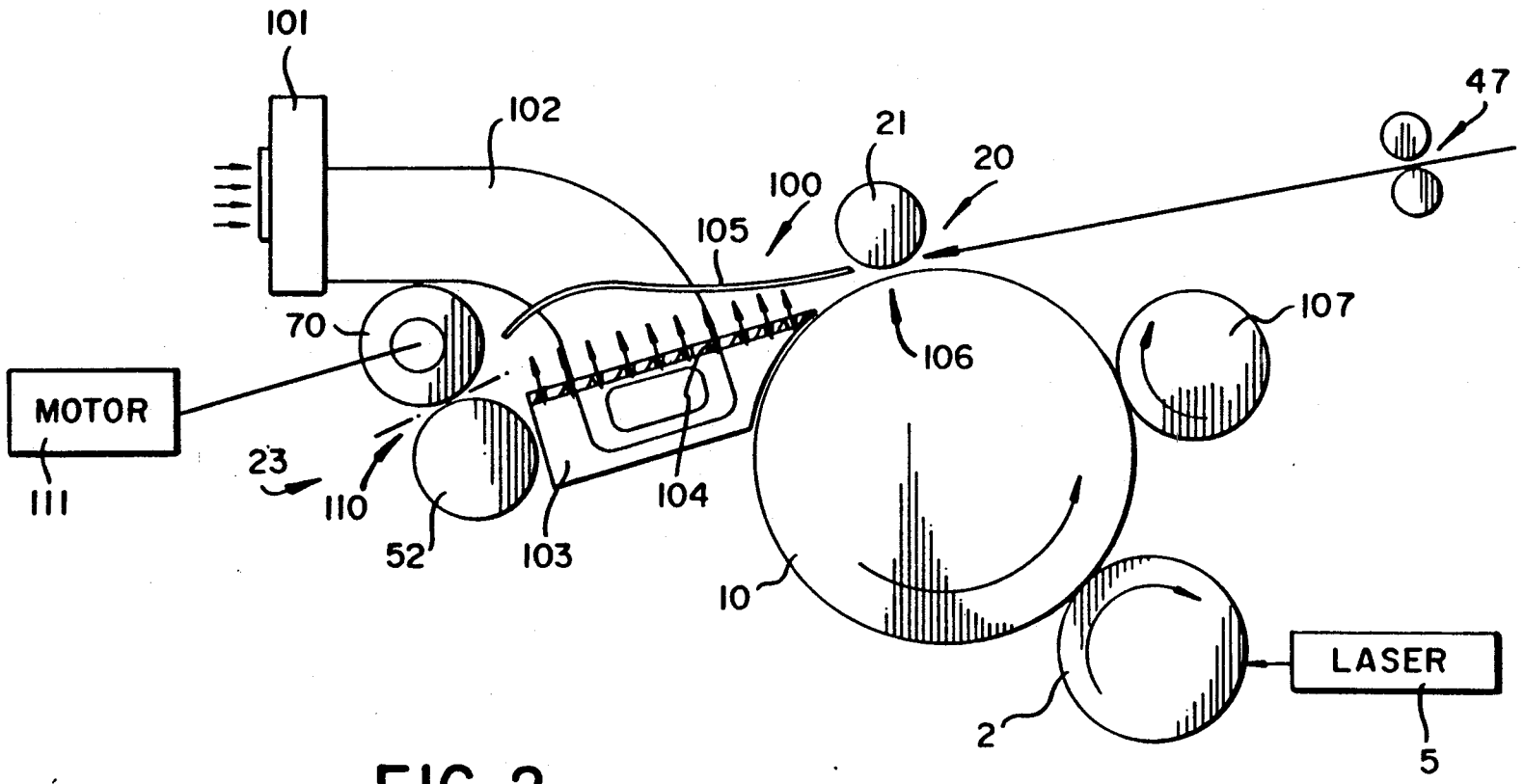
FIG. 2 is a front schematic illustrating the components associated with receiving sheet transport between an image member and fixing device in the image-forming apparatus shown in FIG. 1.

Referring to FIG. 2, a receiving sheet fed from timing rollers 47 enters a transfer nip 106 formed by transfer backing roller 21 and intermediate drum 10. Transfer roller 21 is out of contact with drum 10 while the images are being transferred to drum 10. It is moved into position, forming nip 106 as the full multicolor image approaches transfer station 20. The toner image is transferred from drum 10 to the bottom or first side of the receiving sheet in the nip 106, and the receiving sheet leaves the nip with the toner image loosely adhering to it. For various reasons, primarily having to do with the beam strength of the sheet, and the relative size and hardness of roller 21 and drum 10, the receiving sheet does not stick to drum 10.

A blower 101 feeds air through a duct 102 to a plenum chamber 103 directly below the proposed path for the receiving sheet. Air from the blower is forced out through an orifice plate 104 positioned on the bottom or first side of the receiving sheet, which is the side carrying the image in this embodiment. Air from the orifice plate against the first side of the sheet forces the receiving sheet upward toward a paper guide 105 positioned on the top, second or nonimage-bearing side of the receiving sheet. Paper guide 105 is curved to guide the paper through a curvilinear path from intermediate image member 10 and nip 106 to fuser 23. Fuser 23 is a pressure roller fuser including a fusing roller 52 and a pressure roller 70 which rollers form a nip 110 that is tilted somewhat to accept the receiving sheet coming from the curvilinear path. The fuser is driven by a motor 111 which drives pressure roller 70 at a speed that moves the receiving sheet very slightly faster than it is being driven by intermediate image member 10. Fusing roller 52 is driven by pressure roller 70 through direct frictional contact and through any receiving sheet in nip 110.

Figure 3:
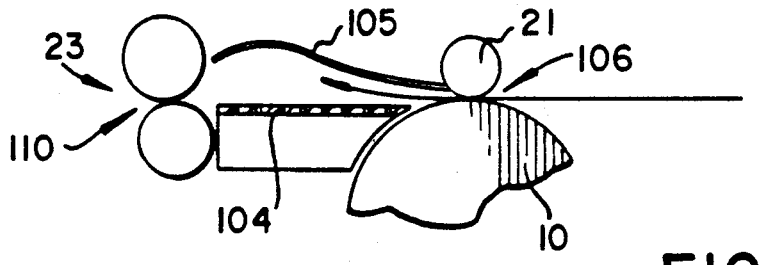
FIGS. 3, 4, 5 and 6 are front schematics similar to FIG. 2 illustrating different positions of movement of the receiving sheet through transport path.
Figure 4:
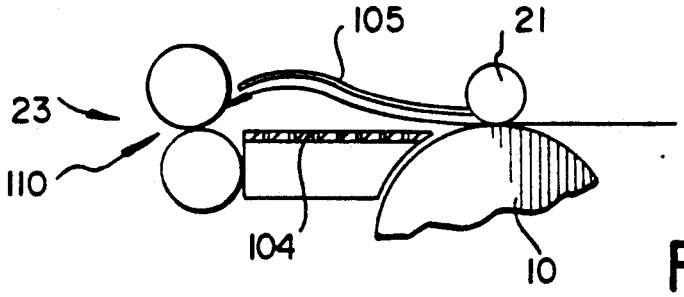
Figure 5:
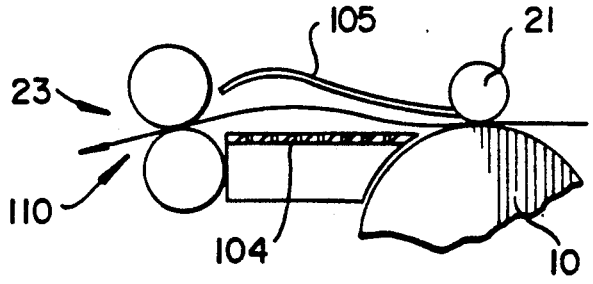
Figure 6:
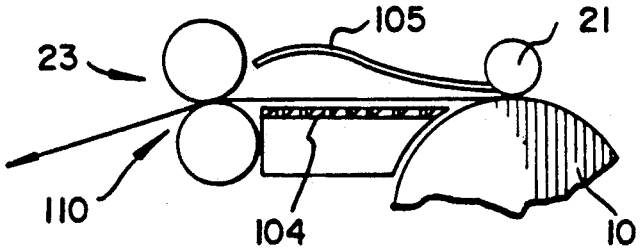

FIGS. 3-6 illustrate the movement of the receiving sheet between intermediate image member 10 and fuser 23. As shown in FIG. 3, as the sheet exits transfer nip 106, it is immediately deflected toward guide 105 by air coming through orifice plate 104. Guide 105 is curved to provide a substantially increased path length compared to the path a sheet would follow if it went straight. Guide 105 is also curved downward at its left end, as seen in FIG. 4, to direct the receiving sheet down into the nip 110 of fuser 23. Because fuser 23 drives the receiving sheet slightly faster than does intermediate image member 10, the receiving sheet gradually begins to straighten against the force of the air coming from orifice plate 104, as shown in FIG. 5. Preferably, the receiving sheet exits the transfer nip 106 before or as it becomes fully straight, as shown in FIG. 6. When it is released by nip 106, it immediately is pushed up against guide 105 by the air from orifice plate 104 and degradation of the image by a speed mismatch between nip 110 and intermediate image member 10 is no longer possible.

Note that the fusing and pressure rollers 52 and 70 are positioned so that a plane bisecting the angle between the guide 105 and orifice plate 104 in the vicinity of the nip 110 is close to a plane bisecting the angle of the two rollers at entrance to the nip. Thus, the rollers are tilted backward to accommodate the curved path of the sheet as it enters the nip, but not too far to cause excessive wrap on the fusing roller 52 when the sheet is straightened out before release by nip 106. This assures a clean entrance to the nip 110 without overheating of the middle of the sheet.

This structure can permit placing of fuser 23 relatively close to intermediate image member 10. For example, 11 and 14 inch receiving sheets can be successfully handled by the apparatus shown in FIGS. 2-6 with only seven inches (in a straight line) separating nip 110 and nip 106. This type of transport can be used from an image member such as intermediate transfer drum 10 as shown in the FIGS. Alternatively, it can also be used from a photoconductive drum, an intermediate or photoconductive web or similar structures. It can also be used to transport a transfer sheet from a transfer drum to which it has been affixed in receiving several color toner images. It is particularly usable in relatively small image-forming apparatus, because it greatly reduces the transport path and thereby makes the apparatus generally more compact.

Factors contributing to speed variation in both the transfer and fuser nips include nip pressure, paper thickness, relative humidity, aging of the rollers, size tolerance of the rollers due to manufacturing and the actual motor speed tolerance. The sum of all the factors can be as high as 3.5% total speed variation. A difference in path length between the curved paper guide shown and the straight line nip distance is capable of absorbing this entire total speed variation. Thus, if the fuser is set to run nominally at a speed, say, 1.75% faster than the image member and the tolerance factors stack up in the worst case positive direction, then the fuser would be running 3.5% faster than the transfer nip and all the slack in the sheet will be taken up during its travel through the system. Similarly, if the tolerance factors stack up in the worst case negative direction, then the fuser would be running at the same speed as the transfer and none of the slack in the sheet will be taken up. Note that if the fuser is allowed to run slower than the transfer nip, extra slack will be induced and the sheet will buckle. Both buckle of the sheet and stretch of the sheet are undesirable.

Figure 7:
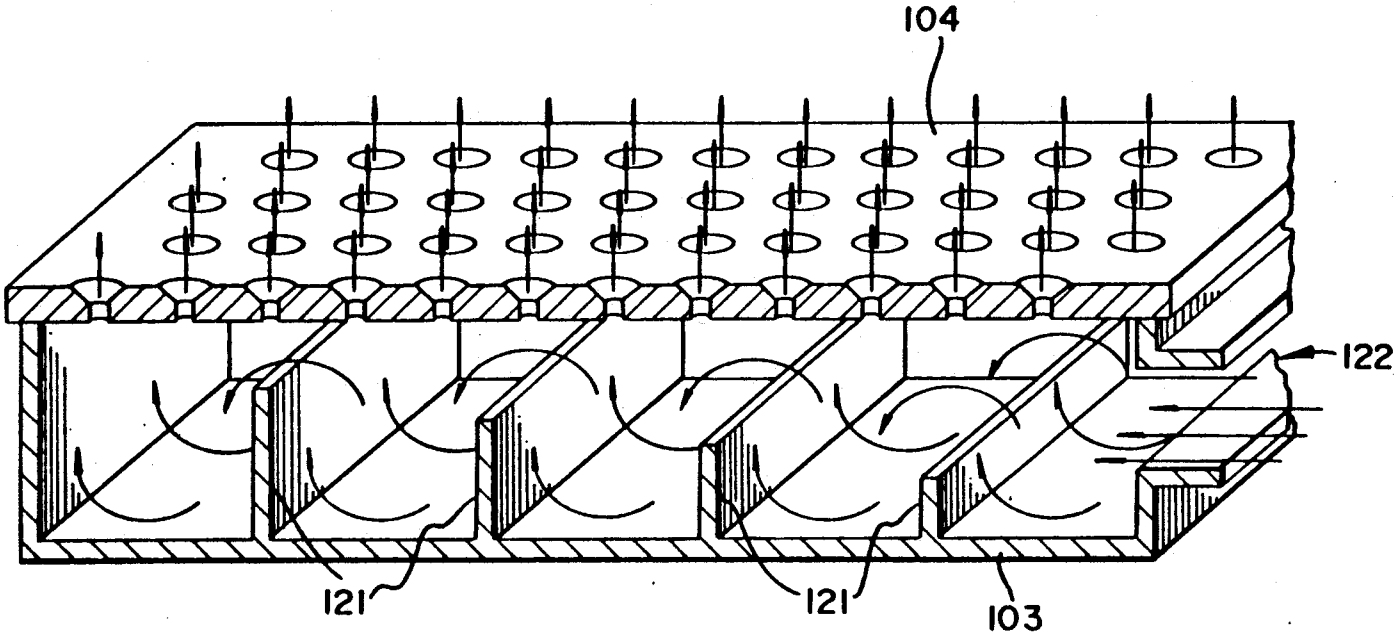
FIG. 7 is a perspective view of the air supply portion of an air transport device usable in the transport shown in FIGS. 2–6.

Referring to FIG. 7, the orifice plate contains holes which, to increase their efficiency, are wider at the air exits than they are at the air entrances. A large number of holes are arranged in staggered rows. Hole size and distribution plus blower performance characteristics and general system impedance characteristics generally determine the character of the air pushing on the image side of the receiving sheet. The actual specifications will vary with the application and can be determined empirically or by using straightforward algorithms. The specifications are set to provide an amount of air that will force the receiving sheet against the guide but will not disturb the image. This system has shown substantial tolerance.

Once the orifice plate is optimized, it is preferred that even pressure distribution be obtained, at least in the crosstrack direction. As shown in FIG. 7, a set of baffles 121 are positioned across the flow of air and increase in height the further away they are from a duct entrance 122. Prior technology used a simple tapered plenum to achieve even pressure, but the tapered baffle approach has turned out to be more effective. This further permits individual baffle plates to be finely tuned by forming raised or lowered portions in them, if necessary, in any given system. Note, this allows varying the pressure distribution in the intrack direction, even though the duct entrance is from the side of the path.

By pushing the sheet up against the paper guide, manufacture of the orifice plate becomes quite inexpensive. It costs a very small fraction of the cost of the original UCAT orifice plate which is required to maintain a sheet between guides. Pushing the sheet upward against a paper guide also ensures an accurate and repeatable entry trajectory into the tilted fuser nip which is important for wrinkle-free fusing.

Figure 8:
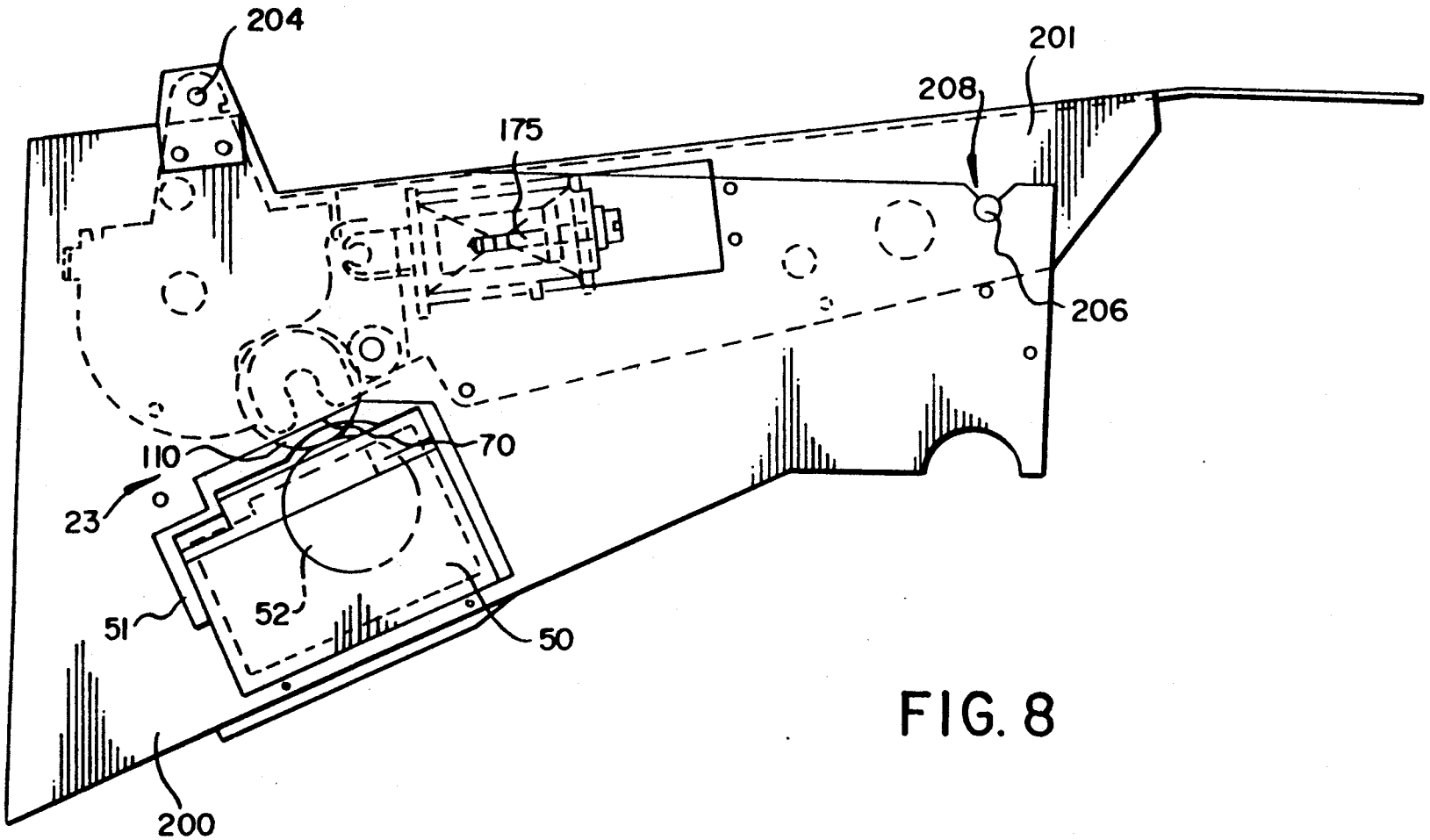
FIG. 8 is a front view generally illustrating the fixing device shown in FIG. 2 and its relation to upper and lower frames of the image-forming apparatus.
Figure 9:
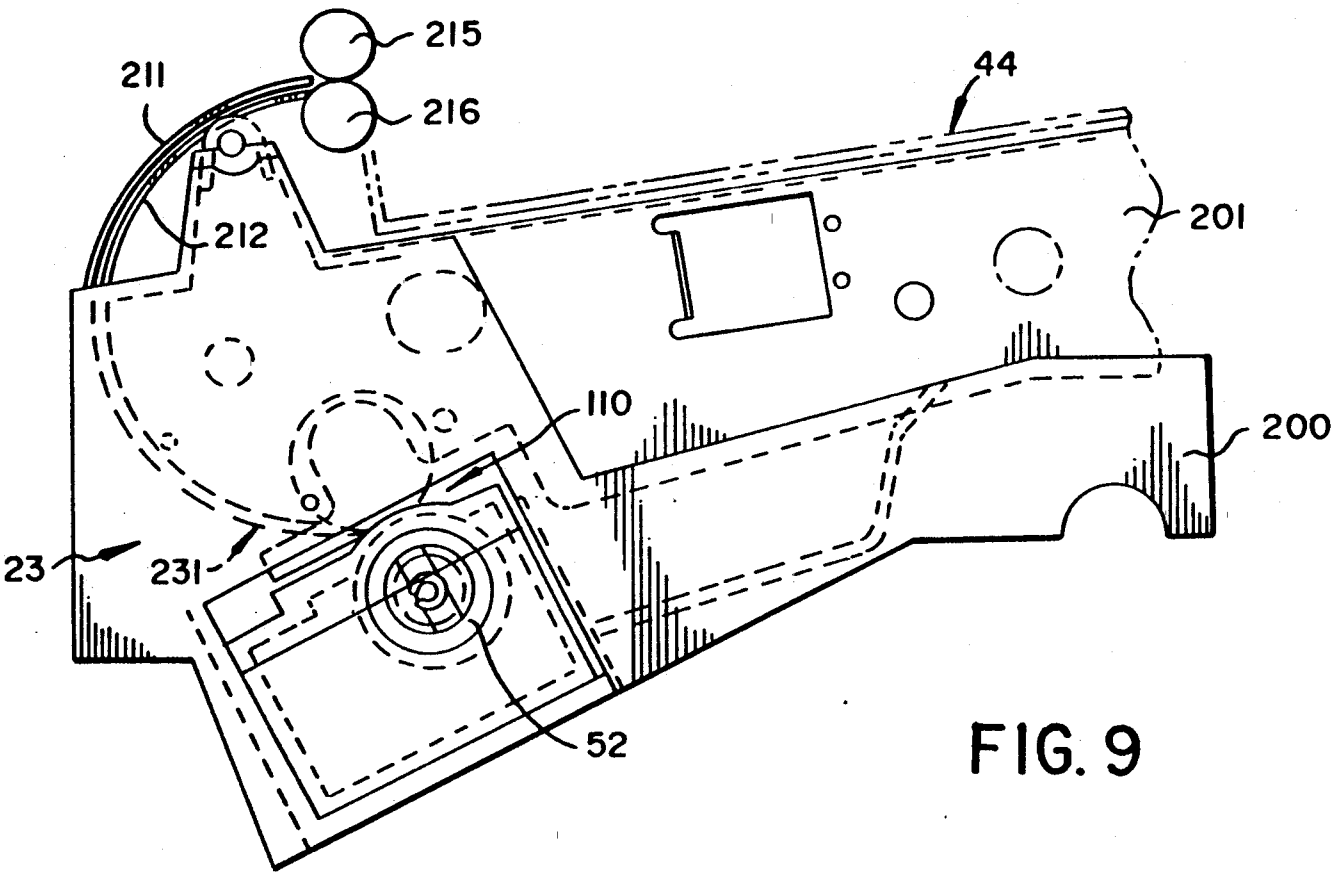
FIGS. 9 and 10 are front views similar to FIG. 8 illustrating different operative positions of an upper frame shown in FIG. 8.
Figure 10:
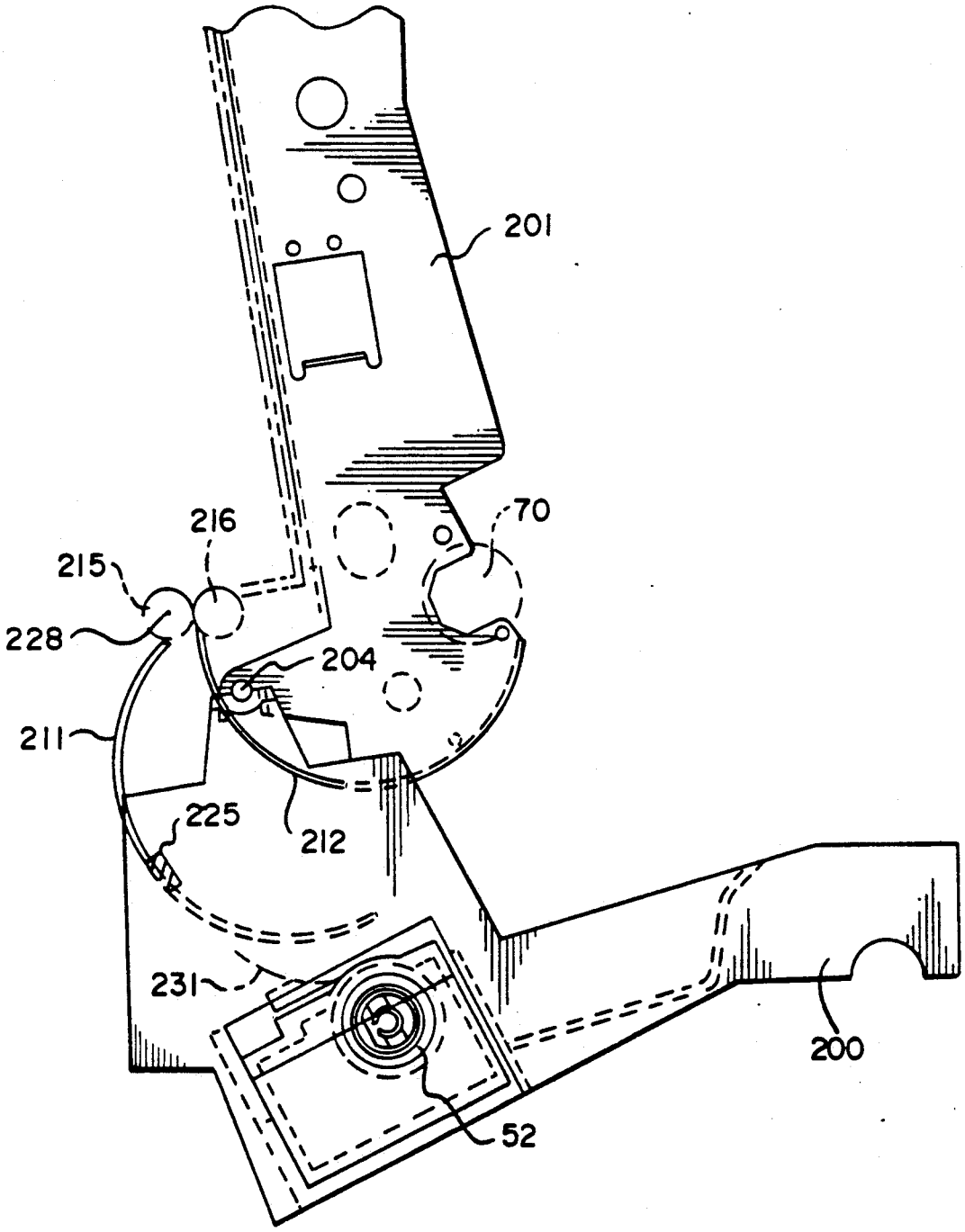

FIGS. 8, 9 and 10 illustrate a mechanism permitting clearing of the fuser 23 of receiving sheet jams. According to FIG. 8, fuser 23 includes the fusing roller 52 and the pressure roller 70 which are spring urged together to form the pressure fusing nip 110. The fusing roller 52 is supplied in a fusing roller cartridge 50 which is inserted endwise in an opening 51 in a lower frame 200 of image-forming apparatus 1. Lower frame 200 also supports intermediate image member 10, plenum chamber 103 and blower 101 which are not shown in FIG. 8.

Pressure roller 70 is supported by an upper frame 201. Upper frame 201 is coupled to lower frame 200 at a pivot 204. Upper frame 201 is shown in FIG. 8 in its lowered or operative position with a pair of studs 206 fixed to upper frame 201 seated in a pair of slots 208 in lower frame portion 200. Only one stud 206 is shown, but it should be understood that there is another stud and slot set at the rear of the upper and lower frames. In this position, springs 175 provide force on pressure roller 70 providing pressure in nip 110.

As seen in FIG. 9, the receiving sheet which exits fusing nip 110 is guided through approximately a 180° turn by an outer paper guide 211 and an inner paper guide 212 which define a guide slot leading the sheet to first and second paper transport rollers 215 and 216, respectively. The paper transport rollers 215 and 216 are above fuser 23 and are driven to continue transport of the receiving sheet after it leaves the fusing nip 110 and ultimately feed it into an output tray 44.

It is known to swing an upper section of a fuser, including a pressure roller, away from a lower section including a fusing roller to clear receiving sheet jams. However, in rotating an upper section of this type away from the fusing roller, it becomes possible for the operator clearing the jam to touch the fusing roller and be burned. Similarly, paper will sometimes be caught in a pair of guides such as guides 211 and 212 and be difficult to remove because of their length. This is especially true if the paper has become ripped into smaller pieces in the jamming process.

According to FIG. 10, to clear a jam, an operator rotates upper frame 201 about pivot 204 until pressure roller 70 is substantially separated from fuser roller 52 and the space in the fuser 23 in which a jam is likely is available to the operator for clearing. In this process, inner paper guide 212 fully follows upper frame 201 as it moves. At the same time, rollers 215 and 216, which are journaled in upper frame 201, rotate with frame 201 as it moves.

Outer paper guide 211 is secured around the shaft of roller 215 and is free to pivot about the axis of rotation 228 of roller 215. Outer paper guide 211 has a tendency to follow upper frame 201 due to gravity and, in fact, moves with the inner guide until outer paper guide 211 hits a stop 225 positioned on lower frame 200. Inner paper guide 212 is notched to miss stop 225 as upper frame 201 is opened.

With outer paper guide 211 stopped by stop 225 and upper frame 201 opening inner paper guide 212 away from it, the slot defined by guides 211 and 212 is open sufficiently for the operator to remove any portions of any receiving sheet that are between guides 211 and 212. The limited movement of outer paper guide 211 brings it to a position directly above fusing roller 52 where it inhibits an operator from touching what may be a very hot fusing roller. Thus, this structure, automatically, both opens the guides leading away from the fusing nip and protects the operator from touching the fusing roller, as part of the swinging of upper frame section 201 to its open position.

A fixed guide 231 mates with outer guide 211 when in the closed position shown in FIG. 9. The fixed guide 231 also helps define the slot into which the transfer sheet goes immediately as it exits the fuser nip 110.

Although not shown in FIGS. 8–10, the curved transport guide 105 and the transfer roller 21 are also located in the upper frame 201 and are moved away from the lower section when that section is opened. Thus, any jam downstream of timing rollers 47 can be cleared by movement of upper section 201 to its open position.

The invention has been described in detail with particular reference to a preferred embodiment thereof, but it will be understood that variations and modifications can be effected within the spirit and scope of the invention as described hereinabove and as defined in the appended claims.

We claim:

1. Image-forming apparatus comprising:

a movable image member, means for forming a toner image on said image member, means for feeding a first side of a receiving sheet having first and second sides into contact with the toner image on said image member, a transfer station, said transfer station including means for forming a transfer station nip with said image member for transferring the toner image to the first side of the receiving sheet, movement of said image member through said transfer station nip moving the receiving sheet beyond said transfer station nip at a first speed, a fixing station, said fixing station including means for fixing said toner image to the receiving sheet and means forming a nip for receiving the sheet while the sheet is being advanced solely by the image member and for transporting the sheet through the fixing station at a second speed that can vary with respect to the first speed, means for controlling movement of the receiving sheet by the image member between the transfer station and the fixing station, said controlling means including, a guide positioned on the second side of the receiving sheet as it moves between said stations, and air control means urging the sheet against said guide as it moves between said stations, said guide being shaped to guide the sheet along a curved path to the fixing station.

2. Apparatus according to claim 1 wherein said air control means includes means for directing air onto the first side of the receiving sheet with sufficient force to urge the sheet into contact with the guide without disturbing the toner image.

3. Apparatus according to claim 2 wherein said transfer and fixing stations are positioned so that the first side of said sheet faces downward as the sheet moves from the transfer station to the fixing station and said means for directing air is positioned to direct air in a generally upward direction.

4. Apparatus according to claim 2 wherein said guide is shaped to define a path for said sheet that is longer than a straight line path between said nips.

5. Apparatus according to claim 4 further including means for driving said fixing station nip forming means at a speed that tends to move the sheet faster than the image member moves the sheet to gradually move the sheet away from said guide.

6. Image-forming apparatus comprising:

a movable image member having an image surface, means for moving said image member to move said image surface at a first speed, means for forming a toner image on said image surface, means for feeding a first side of a receiving sheet having first and second sides into contact with the toner image on said image surface, a transfer station, said transfer station including means forming a transfer station nip with said image member for transferring the toner image to the first side of the receiving sheet, movement of said image member through said transfer station nip moving the receiving sheet beyond said transfer station nip at said first speed, a fixing station, said fixing station including means for fixing said toner image to the receiving sheet and including means forming a nip for receiving the sheet while the sheet is being moved by the image member and for transporting the sheet through the fixing station, and means for controlling movement of the receiving sheet by the image member between the transfer station and the fixing station, said controlling means including means for directing air at the receiving sheet as it moves between said stations to deflect the sheet away from a straight line path between said stations.

7. Apparatus according to claim 6 further including means for driving said fixing station nip forming means at a second speed that tends to move the sheet faster than said first speed to gradually move the sheet toward said straight line path.

8. Apparatus according to claim 7 further including curved guide means positioned to limit deflection of the sheet by the air directing means.

9. Apparatus according to claim 7 wherein said second speed is insufficiently faster than said first speed to fully straighten said sheet substantially before the sheet leaves the transfer nip.

10. Image-forming apparatus comprising:

means for forming a series of electrostatic images on a moving primary image member, means for applying different colored toner to each of said electrostatic images to form a series of different color toner images, a movable intermediate image member having an image surface, means for moving said intermediate image member to move said image surface at a first speed, mans for transferring said toner images from said primary image member in registration to said image surface to form a multicolor image on said image surface, means for transferring said multicolor image to a receiving sheet, a fixing station having means for fixing the multicolor image to the receiving sheet and means forming a nip drivable to move the sheet through the fixing station at a second speed greater than the first speed, and means for controlling movement of the receiving sheet as the sheet is moved by the image surface to the fixing station, said controlling means including a curved guide on one side of the sheet and means for directing air at the other side of the sheet to deflect the sheet toward the curved guide.

11. Apparatus according to claim 10 wherein the fixing station is positioned to receive the receiving sheet while the image surface is moving the sheet and the faster speed of the fixing nip gradually reduces the deflection of the sheet by the air directing means.

12. Apparatus according to claim 11 wherein the means for transferring the multicolor image to a receiving sheet includes a transfer roller articulatable toward said image surface to form a transfer nip with said image surface, and said transfer nip and fixing nip are so positioned that the deflection of the sheet is not totally eliminated substantially prior to the trailing edge of the sheet leaving the transfer nip.

13. Apparatus according to claim 10 wherein the intermediate image member is a transfer drum and the image surface is an outer peripheral surface of the drum.

14. Apparatus according to claim 13 wherein the means for transferring the multicolor image to a receiving sheet includes a transfer roller articulatable toward said image surface to form a transfer nip with said image surface.

15. Receiving sheet transport device for transporting a receiving sheet having first and second sides and having a loose toner image on the first side from a first station to a second station, said first station including first means for moving said receiving sheet at a first speed and said second station having second means for moving said sheet at a second speed, said device including:

a guide positioned on the second side of the receiving sheet as the receiving sheet is moved by the first moving means, and means for directing air against the first side of the receiving sheet to urge the sheet against the guide, the guide being shaped to guide the sheet along a curved path to the second station.

16. Device according to claim 15 wherein the second speed is faster than the first speed.

17. Device according to claim 15 wherein the guide is curved and the air directing means provides sufficient force to push the sheet substantially against the guide without disturbing the toner image.

* * * * *

UNITED STATES PATENT AND TRADEMARK OFFICE

CERTIFICATE OF CORRECTION

PATENT NO. : 5,223,903

DATED : June 29, 1993

INVENTOR(S) : Steven M. Russel, et al.

It is certified that error appears in the above-identified patent and that said Letters Patent is hereby corrected as shown below:

Column 8, line 18, delete "mans" and insert --means--.

Signed and Sealed this

Twenty-second Day of February, 1994

*Attest:*

Bruce Lehman

BRUCE LEHMAN

*Attesting Officer*

*Commissioner of Patents and Trademarks*